US011008684B2

(12) United States Patent
Groelz

(10) Patent No.: US 11,008,684 B2
(45) Date of Patent: May 18, 2021

(54) FELTING ASSEMBLY FOR A QUILTING MACHINE

(71) Applicant: HANDI QUILTER, INC., North Salt Lake, UT (US)

(72) Inventor: Brenda Lee Groelz, Syracuse, UT (US)

(73) Assignee: HANDI QUILTER, INC., North Salt Lake, UT (US)

( * ) Notice: Subject to any disclaimer, the term of this patent is extended or adjusted under 35 U.S.C. 154(b) by 120 days.

(21) Appl. No.: 16/404,359

(22) Filed: May 6, 2019

(65) Prior Publication Data

US 2020/0354870 A1 Nov. 12, 2020

(51) Int. Cl.
*D04H 18/02* (2012.01)
*D05B 23/00* (2006.01)

(52) U.S. Cl.
CPC ..... *D04H 18/02* (2013.01); *D05B 23/00* (2013.01)

(58) Field of Classification Search
CPC ..... D04H 18/02; D04H 17/00; D04H 3/102; D04H 1/46; D04H 18/00; D05B 23/00; D05B 81/00; D05B 55/10; D05C 7/02
See application file for complete search history.

(56) References Cited

U.S. PATENT DOCUMENTS 4,353,158 A * 10/1982 Henshaw ..... D04H 13/00 112/152
7,096,807 B1 * 8/2006 Chang ..... D05B 55/02 112/226
2011/0174204 A1 * 7/2011 Berwanger ..... D04H 18/00 112/222
2013/0255047 A1 * 10/2013 Sasur ..... D04H 17/00 28/108
2015/0259838 A1 * 9/2015 Schwarzberger ..... D05B 19/14 112/475.17
2017/0081795 A1 * 3/2017 Hanada ..... D05B 73/12
(Continued)

FOREIGN PATENT DOCUMENTS

JP 2004222896 A * 8/2004
JP 2004329483 A * 11/2004

OTHER PUBLICATIONS

English translation of JP2004329483 obtained via espacenet.com (last visited Oct. 27, 2020).*
(Continued)

*Primary Examiner* — Alissa L Hoey
*Assistant Examiner* — Patrick J. Lynch
(74) *Attorney, Agent, or Firm* — Maschoff Brennan

(57) ABSTRACT

Felting assembly for a sewing machine. In some embodiments, a felting assembly may include a felting needle clamp including one or more felting needles. The felting assembly may also include a needle plate defining one or more needle openings arranged to allow the one or more felting needles to reciprocate therethrough. The needle plate may be configured to be attached to a sewing machine over a rotary hook of the sewing machine. The felting assembly may also include a connector configured to attach the felting needle clamp to a needle bar of the sewing machine such that the felting needle clamp is offset from the rotary hook of the sewing machine to avoid the one or more felting needles from contacting the rotary hook when the one or more felting needles are reciprocated through the one or more needle openings in the needle plate.

23 Claims, 10 Drawing Sheets

(56) References Cited

U.S. PATENT DOCUMENTS

| | | | | |
|---|---|---|---|---|
| 2018/0002852 | A1* | 1/2018 | Yamazaki | D05B 23/00 |
| 2018/0103724 | A1* | 4/2018 | Ho | A43D 11/01 |

OTHER PUBLICATIONS

Bernina International AG, Tutorial: how to use the BERNINA punching tool for rotary hook machines, Aug. 15, 2013, https://www.youtube.com/watch?v=K0QffHfwQ6c&feature=youtu.be (last visited Oct. 27, 2020).*

BrotherSupportSewing, [BrotherSupportSewing] (Accessories) Needle Felting Foot: SA280/NFAHS1, Jul. 1, 2019, https://www.youtube.com/watch?v=qw8wP_0ZvBc (last visited Oct. 27, 2020).*

Handi Quilter, Intro to HQ Glide Foot, Aug. 3, 2015 (https://www.youtube.com/watch?v=cobzNrzog08&feature=youtu.be) last visited Jan. 27, 2021.*

Stein, Susan; "Needle Felting with Stencils~Playing with Stencils 3"; Dec. 7, 2009; Cedar Canyon Textiles, Inc.; Webpage; located at: https://cedarcanyontextiles.com/needle-felting-with-stencils-playing-with-stencils-3/; accessed on May 3, 2019; 4 pages.

Threads Magazine; "Needle Felting Without Wool"; The Taunton Press, Inc.; 2019; Webpage; located at: https://www.threadsmagazine.com/2009/07/20/needle-felting-without-wool; accessed on May 6, 2019; 5 pages.

Pinterest; "Discover Ideas about Wet Felting"; Webpage; located at: https://www.pinterest.com/pin/97460779411405771/; accessed on May 6, 2019.

Ken's Sewing Center, Since 1971; Janome Felting 5 Needle Unit for FM725; Webpage; located at: https://www.kenssewingcenter.com/janome-felting-5-needle-unit-for-fm725.html?gclid=CjwKCAjwza_mBRBTEiwASDWVvtSsx7WQTzIEMzXjbRC0MTwA6hKYOnKCPvYBnASr0QewT2PmndwOixoCZEQQAvD_BwE; accessed on May 6, 2019; 3 pages.

* cited by examiner

FELTING ASSEMBLY FOR A QUILTING MACHINE

BACKGROUND

Sewing machines generally function to form a row of stitches in one or more layers of fabric using a combination of thread from a spool, also known as top thread, and thread from a bobbin, also known as bottom thread. A sewing machine generally operates using a sewing needle threaded with the top thread and a bobbin threaded with the bottom thread. Once threaded, the sewing machine generally forms a row of stitches by repeatedly reciprocating the sewing needle through the one or more layers of fabric while simultaneously rotating a rotary hook connected to the bobbin thread underneath the one or more layers of fabric.

During operation, sewing machines are generally configured either to remain stationary during operation or to be repositioned during operation. Stationary sewing machines (sometimes also referred to as sit-down sewing machines) are generally configured to remain stationary while a user repositions one or more layers of fabric in a desired direction underneath the needle. Maneuverable sewing machines (sometimes also referred to as stand-up sewing machines) are generally configured to be mounted upon a sewing machine carriage, while one or more layers of fabric are mounted in a stationary frame, to allow a user to reposition the sewing machine needle in a desired direction over the fabric.

Like a sewing machine, a felting machine also includes one or more reciprocating needles, but instead of a threaded sewing needle configured to sew a row of stitches, a felting machine includes one or more felting needles configured to mesh layers of fabric together by pressing and pulling fibers between the layers of fabric using barbs on the felting needles. In some applications, the fibers mingle to create new color and texture combinations that cannot be achieved with embroidery, applique, or other kind of needlework. For example, a felting machine may function to incorporate fibers from a first layer of material into a second layer of material by using the barbs on felting needles to press fibers from the first layer into the second layer and/or to pull fibers from the first layer into the second layer.

The subject matter claimed herein is not limited to embodiments that solve any disadvantages or that operate only in environments such as those described above. Rather, this background is only provided to illustrate one example technology area where some embodiments described herein may be practiced.

SUMMARY

Some embodiments disclosed herein may include a felting assembly for a sewing machine. The felting assembly may include a felting needle clamp including one or more felting needles. The felting assembly may also include a needle plate defining one or more needle openings arranged to allow the one or more felting needles to reciprocate therethrough. The needle plate may be configured to be attached to a sewing machine over a rotary hook of the sewing machine. The felting assembly may also include a connector configured to attach the felting needle clamp to a needle bar of the sewing machine such that the felting needle clamp is offset from the rotary hook of the sewing machine to avoid the one or more felting needles from contacting the rotary hook when the one or more felting needles are reciprocated through the one or more needle openings in the needle plate.

In some embodiments, the felting assembly may also include a hopping foot configured to be attached to a presser bar of the sewing machine. The hopping foot may define a bowl. The hopping foot may be configured to press fabric down against the needle plate. In these embodiments, the bowl may surround and define a felting opening that may be configured to allow the one or more felting needles to reciprocate therethrough. In these embodiments, the bowl may further define an open gap that may be configured such that the hopping foot avoids the connector and the needle bar. In these or other embodiments, an outer edge of the bowl may be configured to flatten a fibrous material against the fabric as the bowl is reciprocated over the fibrous material and the fabric.

In some embodiments, the one or more needle openings defined in the needle plate may include a first set of one or more needle openings arranged to be positioned beneath the one or more felting needles when the needle plate is attached to the sewing machine in a first orientation, and a second set of one or more needle openings arranged to be positioned beneath the one or more felting needles when the needle plate is attached to a second sewing machine in a second orientation.

In some embodiments, the connector may define a first opening configured to receive and attach to the needle bar and a second opening configured to receive and attach to the felting needle clamp.

In some embodiments the sewing machine may be a long-arm quilting machine.

Some embodiments disclosed herein may include a felting assembly for a sewing machine. The felting assembly may include a felting needle clamp including one or more felting needles. The felting needle clamp may be configured to be coupled to a needle bar of a sewing machine. The felting assembly may also include a needle plate defining one or more needle openings arranged to receive the one or more felting needles. The needle plate may be configured to be attached to the sewing machine. The felting assembly may also include a hopping foot defining a felting opening configured to allow the one or more felting needles to reciprocate therethrough. The hopping foot may be configured to be coupled to a presser bar of the sewing machine such that the hopping foot is configured to reciprocate between pressing fabric down against the needle plate before the one or more felting needles have reciprocated into the fabric and lifting off of the fabric after the one or more felting needles have reciprocated out of the fabric.

In some embodiments, the needle plate may be configured to be attached to the sewing machine over a rotary hook of the sewing machine. The felting assembly may further include a connector configured to couple the felting needle clamp to the needle bar of the sewing machine such that the felting needle clamp is offset from the rotary hook of the sewing machine to avoid the one or more felting needles from contacting the rotary hook when the one or more felting needles are reciprocated through the one or more needle openings in the needle plate. In these embodiments, the hopping foot may define a bowl surrounding the felting opening. In these embodiments, the bowl may define an open gap that may be configured such that the hopping foot avoids the connector and the needle bar. In these embodiments, an outer edge of the bowl may be configured to flatten a fibrous material against the fabric as the bowl is reciprocated over the fibrous material and the fabric.

In some embodiments, a sewing machine may include a frame, a needle bar coupled to the frame and configured to reciprocate, a rotary hook coupled to the frame and configured to rotate, and a felting assembly. The felting assembly may include a felting needle clamp including one or more felting needles, a needle plate, and a connector. The needle plate may define one or more needle openings arranged to allow the one or more felting needles to reciprocate therethrough. The needle plate may be attached to the frame over the rotary hook. The connector may attach the felting needle clamp to the needle bar such that the felting needle clamp is offset from the rotary hook to avoid the one or more felting needles from contacting the rotary hook while the one or more felting needles are reciprocated through the one or more needle openings in the needle plate.

In some embodiments, the sewing machine may further include a presser bar coupled to the frame and configured to reciprocate and a hopping foot attached to the presser bar. The hopping foot may define a felting opening configured to allow the one or more felting needles to reciprocate therethrough. The hopping foot may be configured to reciprocate between pressing fabric down against the needle plate before the one or more felting needles have reciprocated into the fabric and lifting off of the fabric after the one or more felting needles have reciprocated out of the fabric. In these embodiments, the hopping foot may define a bowl that surrounds the felting opening, and the bowl may define an open gap configured such that the hopping foot avoids the connector and the needle bar. The hopping foot may include an outer edge of the bowl configured to flatten fibrous material against the fabric as the bowl is reciprocated over the fibrous material and the fabric.

In some embodiments, the one or more needle openings defined in the needle plate may be offset from a plane defined by a center axis of the needle bar and a length of the frame.

It is to be understood that both the foregoing general description and the following detailed description are exemplary and explanatory and are not restrictive of the invention as claimed.

BRIEF DESCRIPTION OF THE DRAWINGS

Example embodiments will be described and explained with additional specificity and detail through the use of the accompanying drawings in which.

DETAILED DESCRIPTION

In some applications, it may be advantageous to retrofit a sewing machine with the functionality of a felting machine by generally replacing a reciprocating sewing needle with multiple reciprocating felting needles. However, such a retrofit may be difficult. For example, one difficulty involves felting needles (which may include barbs instead of an eye that is configured to be threaded with a top thread) being clustered in sets of multiple felting needles, and sewing machines may not be configured to accommodate multiple-needle configurations. For example, a typical needle plate of a sewing machine may only include a single hole for a single sewing needle, which may not accommodate multiple felting needles. Also, another difficulty involves a sewing machine typically including a rotary hook under the needle plate that is configured to repeatedly thread bottom thread (from a bobbin) through loops of top thread (threaded on the sewing needle) each time the sewing needle reciprocates below the needle plate. However, when the single sewing needle is replaced with multiple felting needles that also reciprocate below the needle plate, these felting needles may come into contact with the rotary hook unnecessarily (because the rotary hook is only used during sewing and is not used during felting) and thereby damage the felting needles and/or the rotary hook.

Some embodiments disclosed herein include a felting assembly configured to retrofit a sewing machine for felting. In some embodiments, the felting assembly may include a felting needle clamp including one or more felting needles. The felting assembly may also include a needle plate defining one or more needle openings arranged to allow the one or more felting needles to reciprocate therethrough. The needle plate may be configured to be attached to a sewing machine over a rotary hook of the sewing machine. The felting assembly may also include a connector configured to attach the felting needle clamp to a needle bar of the sewing machine such that the felting needle clamp is offset from the rotary hook of the sewing machine to avoid the one or more felting needles from contacting the rotary hook when the one or more felting needles are reciprocated through the one or more needle openings in the needle plate. The felting assembly may also include a hopping foot configured to be attached to a presser bar of the sewing machine. The hopping foot may define a bowl and be configured to press fabric and/or a fibrous material down against the needle plate.

Therefore, some embodiments disclosed herein may enable a sewing machine to function as both a sewing machine and a felting machine, and/or to be retrofitted as a felting machine, by accommodating one or more felting needles instead of only a single sewing needle, and by enabling the one or more felting needles to avoid coming into contact with the rotary hook during felting (e.g., even where the rotary hook is left in place and rotates during felting).

Figure 1A:
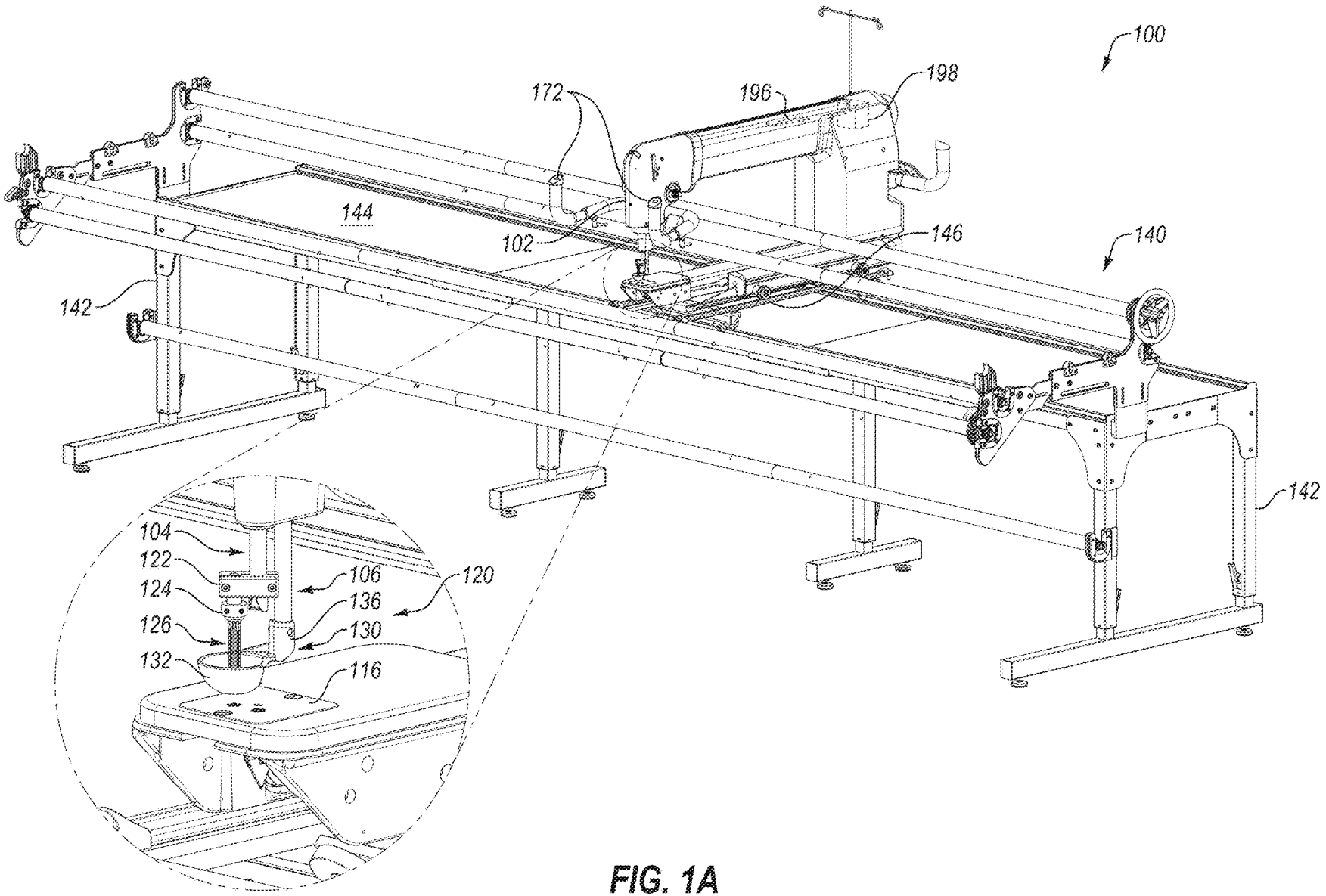
FIG. 1A is a front top perspective view of an example maneuverable sewing machine, with an example felting assembly, mounted on an example fabric frame.
Figure 1B:
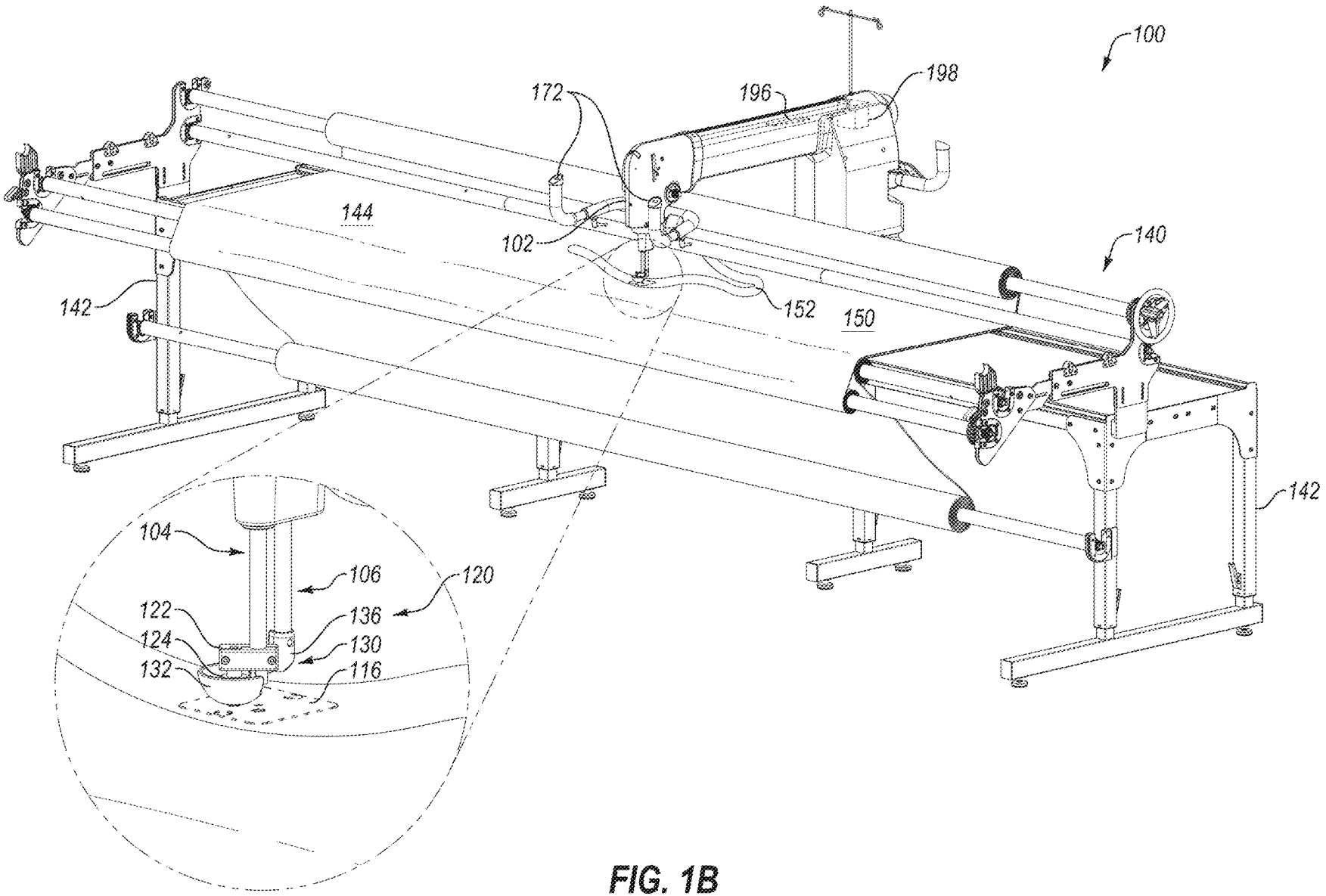
FIG. 1B is a front top perspective view of the example maneuverable sewing machine and example fabric frame of FIG. 1A with fabric positioned thereon.

FIG. 1A is a front top perspective view of an example maneuverable sewing machine 100, including an example felting assembly 120, mounted on an example fabric frame 140. FIG. 1B is a front top perspective view of the example maneuverable sewing machine 100 and the example fabric frame 140 of FIG. 1A with fabric 150 positioned thereon.

The sewing machine 100 of FIGS. 1A and 1B is a quilting machine and, more particularly, a long-arm quilting machine. Quilting typically involves stitching together multiple layers of fabric to form a quilt. A quilt typically includes a layer of batting sandwiched in between upper and lower layers of fabric. A long-arm quilting machine may be distinguished from other types of sewing or quilting machines because of the "long-arm" configuration of the machine, which results in increased throat space and increased vertical space for a quilt to be rolled up, or bunched up, behind the needle. Although the example sewing machine 100 of FIGS. 1A and 1B is a maneuverable long-arm quilting machine, it is understood that the sewing machine 100 of FIGS. 1A and 1B is only one of countless maneuverable sewing machines in which the example felting assembly disclosed herein may be employed. The scope of the example felting assemblies disclosed herein is therefore not intended to be limited to employment in any particular maneuverable sewing machine or quilting machine.

As disclosed in FIGS. 1A and 1B, the sewing machine 100 may include a frame 102 which houses various internal components of the sewing machine 100, such as a processor 196 and a motor 198. The sewing machine 100 may also include a needle bar 104 that is configured to have one or more needles attached thereto and a presser bar 106 that is configured to have a foot attached thereto (for example, a hopping foot 130), along with handlebars 172 attached to the frame 102, among other components. The motor 198 may be configured to cause the needle bar 104 to reciprocate with respect to the frame 102 such that the one or more needles reciprocate into and out of the fabric 150. Simultaneously, the motor 198 may also be configured to cause the presser bar 106 to reciprocate the hopping foot 130 onto and off of the fabric 150, to alternate between holding the fabric 150 in place and releasing the fabric 150 to allow the movement of the sewing machine 100 relative to the fabric 150. In a typical sewing-machine configuration, a top thread from a spool (not shown) may be passed through various thread guides, including a take-up lever, until finally the top thread is threaded through the eye of a sewing needle. Although not shown in FIGS. 1A and 1B, it is understood that the sewing machine 100 may also include a bobbin case configured to hold a bobbin that is wound with bottom thread, and a rotary hook (which may also be driven by the motor 198 or another synchronized motor), all generally positioned in the frame 102 underneath a needle plate 116.

To facilitate use of the sewing machine 100 by a user, the sewing machine 100 may be mounted on a fabric frame 140. The fabric frame 140 may include legs 142 and a table top 144. A sewing machine carriage 146 may be mounted on the table top 144 and the sewing machine 100 may be mounted in the sewing machine carriage 146. This configuration may allow a user to grasp the handlebars 172 that are attached to the frame 102 of the sewing machine 100 and then reposition the sewing machine 100 while sewing over the fabric 150 (such as a backing fabric, a quilt-top fabric, and a batting fabric) spooled on spools of the fabric frame 140. When mounted to the fabric frame 140, the sewing machine 100 is configured as a maneuverable sewing machine (sometimes also referred to as a stand-up sewing machine) in which the user repositions the sewing machine 100 in a desired direction over one or more layers of fabric, such as the fabric 150, which remains stationary due to being mounted in the fabric frame 140. Although three layers of fabric are illustrated in FIG. 1B, any single one of the layers of fabric 150 may be used, or more than three layers of fabric may be used.

In some embodiments, a user may periodically replace a typical sewing needle and other components that would typically be employed in the sewing machine 100 with the felting assembly 120, and vice versa, to switch between using the sewing machine 100 as a sewing machine and as a felting machine. The felting assembly 120 may include a connector 122, a needle clamp 124, and felting needles 126. Additionally or alternatively, in some embodiments, the felting assembly 120 may include the hopping foot 130, which may replace a typical foot (e.g. replace a typical presser foot or a typical hopping foot). The hopping foot 130 may include a bowl 132, a gap 134 (see FIGS. 3A-3B), and a foot connector 136. Additionally or alternatively, in some embodiments, the felting assembly 120 may include the needle plate 116 which may replace a typical needle plate of a typical sewing machine.

Figure 2A:
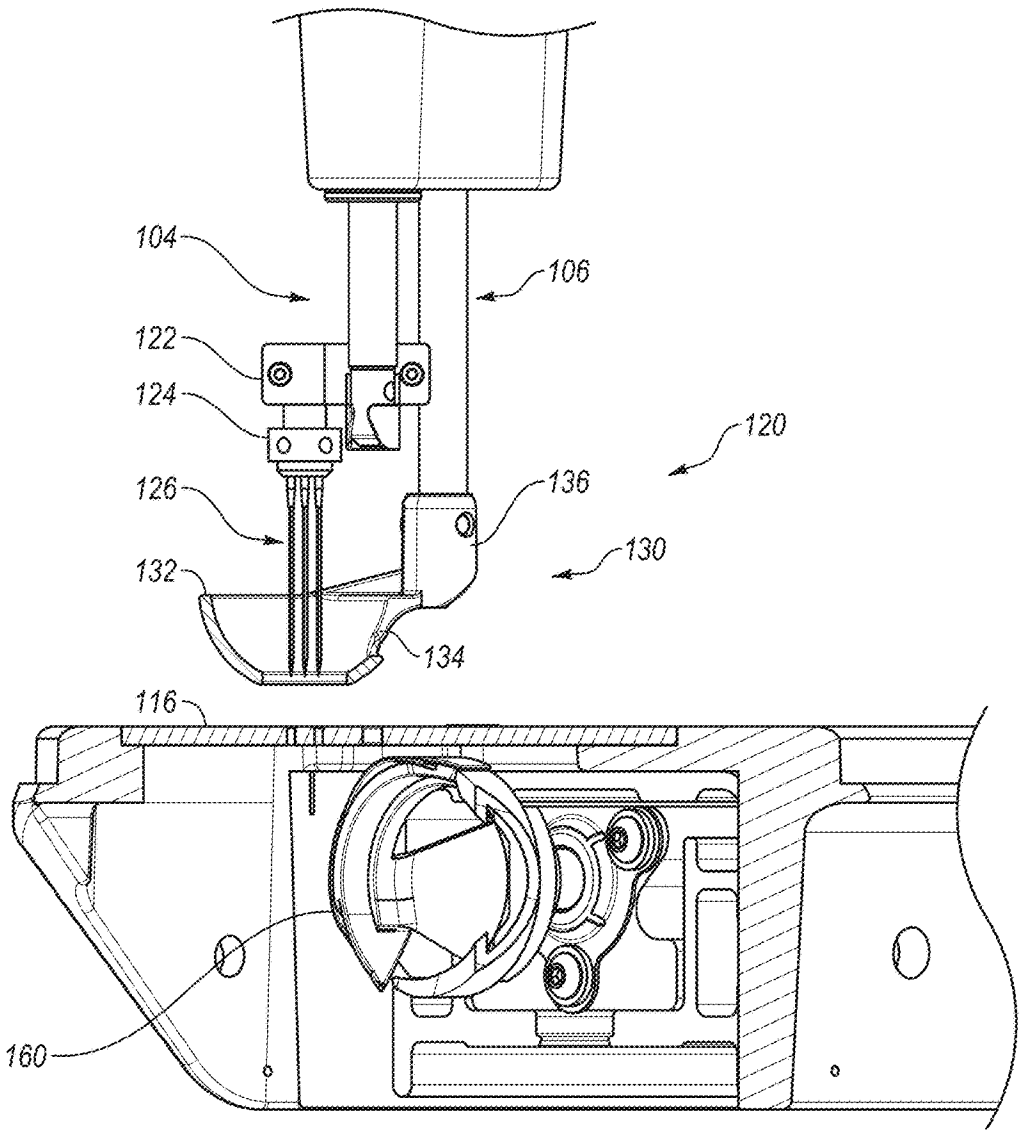
FIG. 2A is a cross-section view of the example maneuverable sewing machine of FIG. 1A with the needle bar in an up position.

FIG. 2A is a cross-section view of the example maneuverable sewing machine 100 of FIG. 1A with the needle bar 104 in an up position. With the needle bar 104 in the up position, the felting needles 126 are above the fabric and/or the fibrous material (not shown in FIG. 2A) being felted. Also, FIG. 2A illustrates the presser bar 106 in an up position in which the hopping foot 130 is not pressing the fabric and/or the fibrous material against the needle plate 116.

Figure 2B:
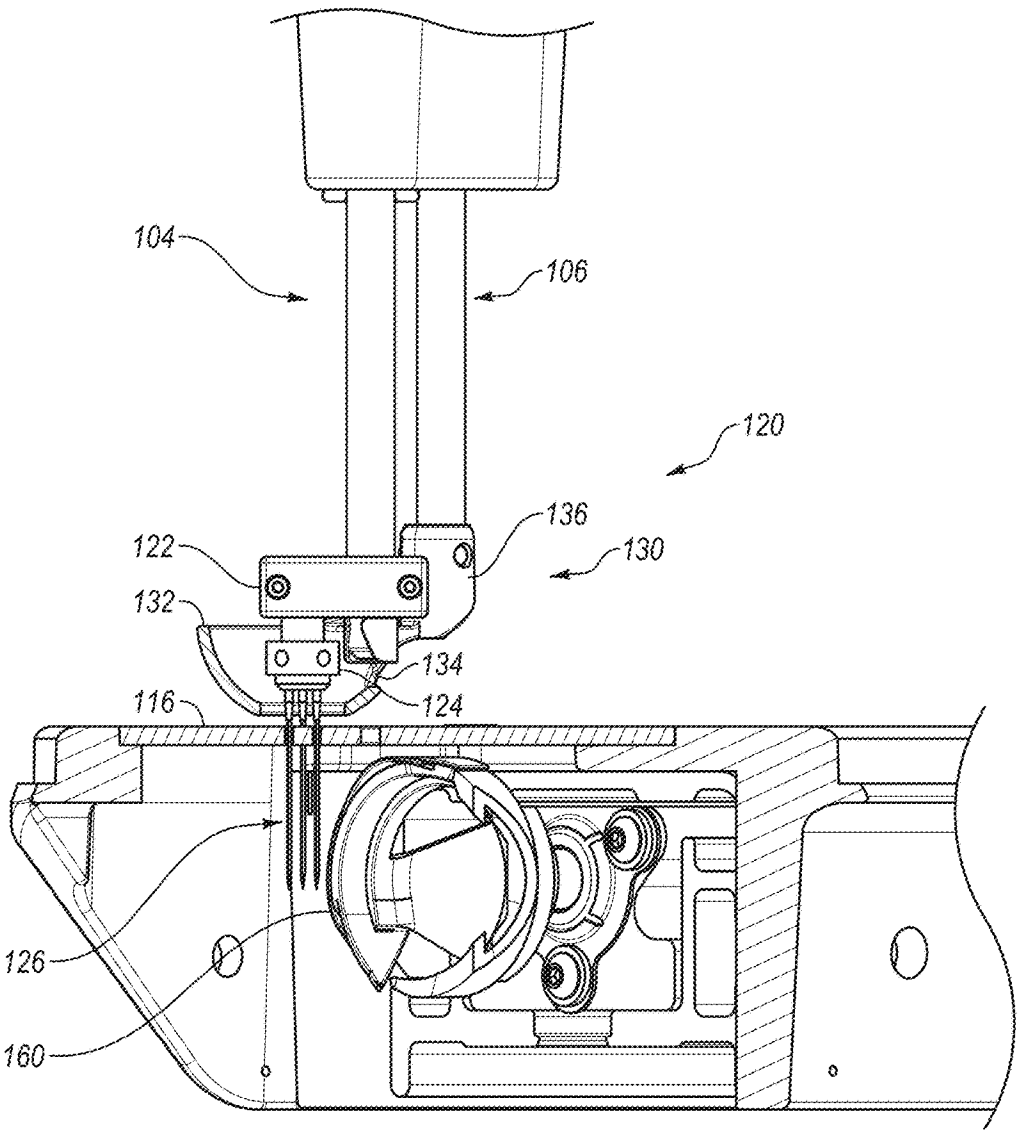
FIG. 2B is a cross-section view of the example maneuverable sewing machine of FIG. 1A with the needle bar in a down position.

FIG. 2B is a cross-section view of the example maneuverable sewing machine 100 of FIG. 1A with the needle bar 104 in a down position. With the needle bar 104 in the down position, portions of the felting needles 126 extend through the needle plate 116. As can be seen in FIG. 2B, with the felting needles 126 reciprocated down through the needle plate 116, because of the offset caused by the connector 122, the felting needles 126 do not contact a rotary hook 160 and/or the bobbin. Also, as can be seen in FIG. 2B, with the presser bar 106 and the attached hopping foot 130 in the down position, and with the needle bar 104 in the down position, the gap 134 receives the connector 122 and/or the needle bar 104, such that the connector 122 and the needle bar 104 do not contact (e.g., interfere with) the hopping foot 130.

Figure 3A:
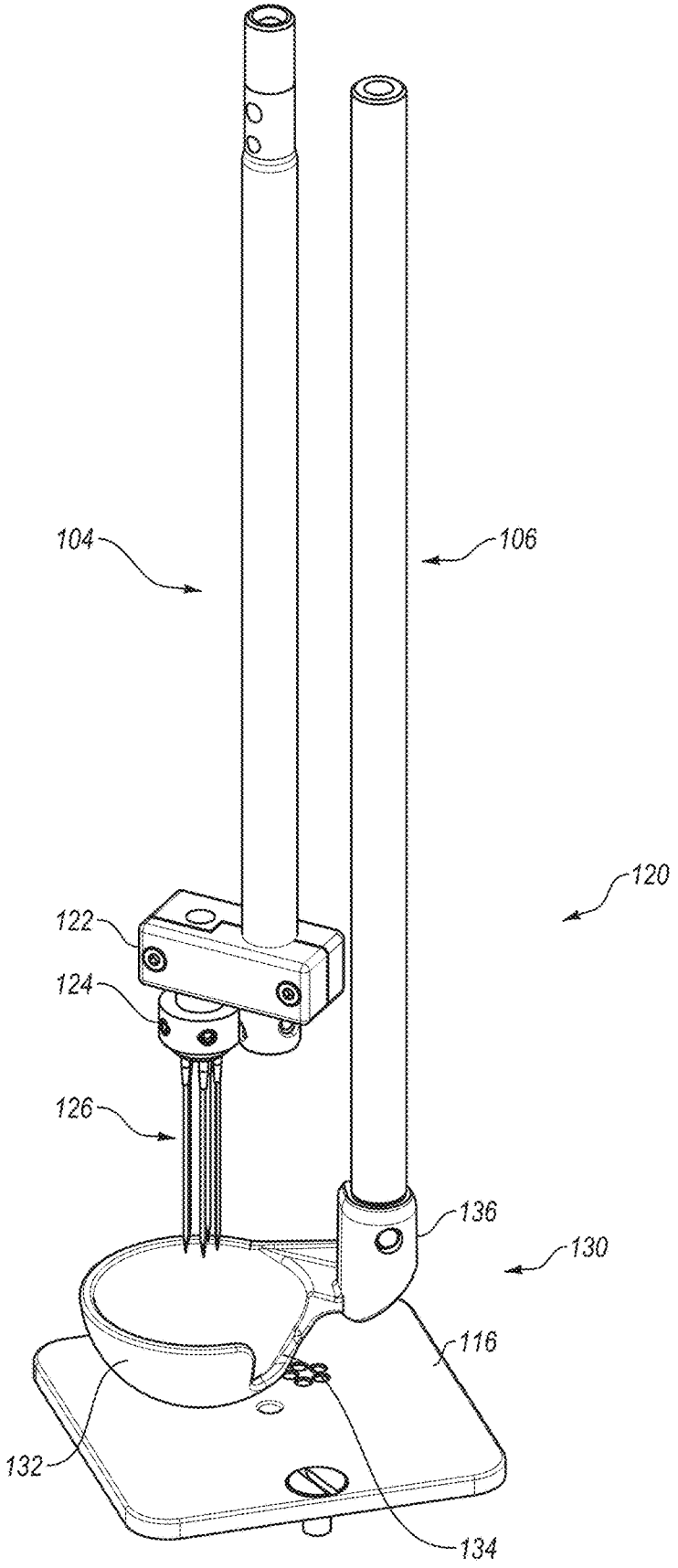
FIG. 3A is a front top perspective view of the example felting assembly of FIG. 1A.
Figure 3B:
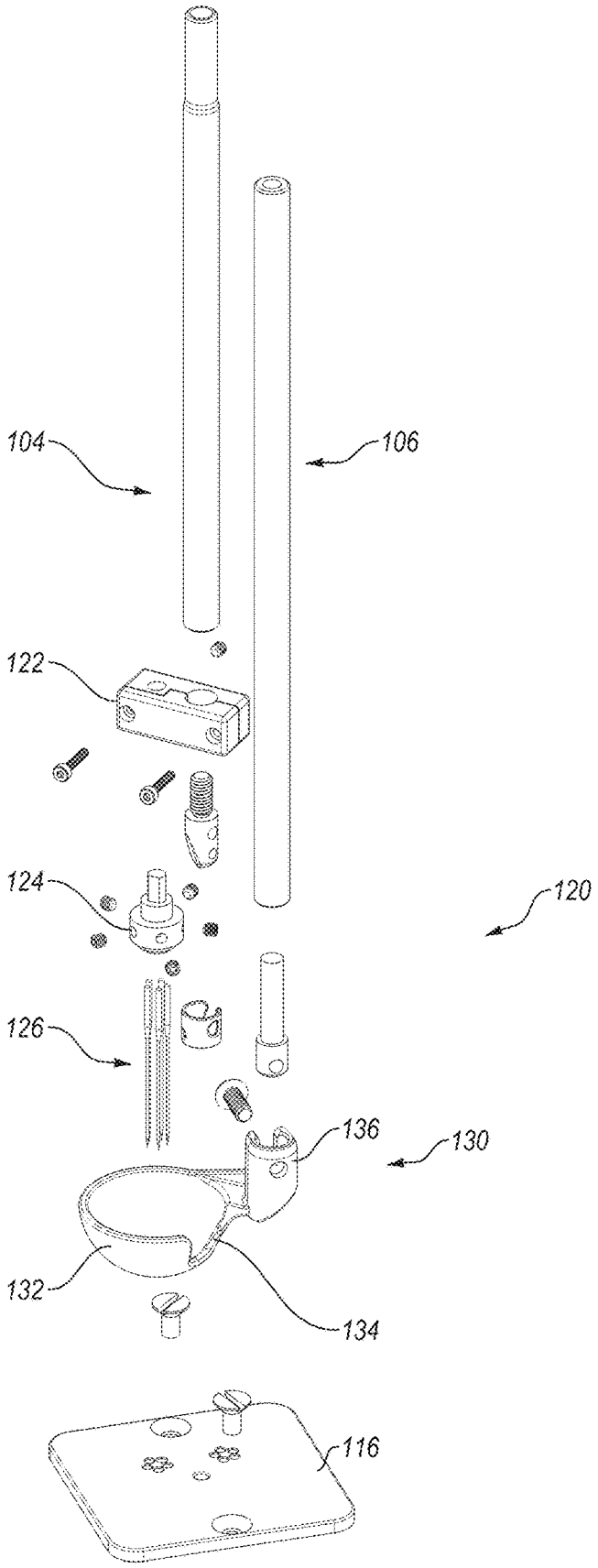
FIG. 3B is an exploded view of the example felting assembly of FIG. 1A.

FIG. 3A is a front top perspective view of the example felting assembly 120 of FIG. 1A. FIG. 3B is an exploded view of the example felting assembly 120 of FIG. 1A. In some embodiments, the felting assembly 120 may include the hopping foot 130. Additionally or alternatively, in some embodiments, the felting assembly 120 may include the needle plate 116.

In some embodiments, the needle clamp 124 may be configured to receive and attach to multiple felting needles 126. In some embodiments, the needle clamp 124 may temporarily attach to each of the felting needles 126 such that any one of the felting needles 126 may be replaced. As an example of how the needle clamp 124 may attach to the felting needles 126, the needle clamp 124 may define multiple needle-base openings on the underside of the needle clamp 124 (e.g. with one needle-base opening corresponding to each of the felting needles 126). The needle clamp 124 may further include multiple set screws that may be tightened to retain the felting needles 126 in the needle-base openings, and that may be loosened so that the felting needles 126 can be removed from the needle-base openings. In some embodiments, the arrangement of the needle-base openings on the underside of the needle clamp 124 may correspond to an arrangement of needle openings in the needle plate 116.

In some embodiments, the felting needles 126 may include barbs configured to pull fibers of a material with the felting needles 126 as the felting needles 126 pass through the material.

In some embodiments, the connector 122 may be configured to couple the needle clamp 124 to the needle bar 104. The connector 122 may define a first opening configured to receive and attach to the needle bar 104 and a second opening configured to receive and attach to the needle clamp 124. As an example of how the connector 122 may attach to the needle bar 104, (or the needle clamp 124) the first opening may include an interior rim configured to fit within a groove on the needle bar 104. The connector 122 may split in two parts allowing the needle bar 104, including the grooved portion, to fit into the first opening. Thereafter, the connector 122 may be reassembled such that the interior rim may fit within the groove of the needle bar 104 to retain the needle bar 104. In these or other embodiments, the connector 122 may include screws that may retain the two parts of the connector 122 together and which may be loosened or removed such that the connector 122 may be split into its two parts.

In some embodiments, the connector 122 may be configured to offset the felting needles 126 from the needle bar 104 and/or a rotary hook and/or a bobbin of the sewing machine 100 (see FIGS. 1A and 1B). In a typical sewing machine, a sewing needle may be generally aligned with a center axis of the needle bar 104. Further, in a typical sewing machine, a rotary hook may be positioned beneath the needle bar 104 such that the rotary hook can feed a bottom thread from a bobbin through loops formed in a top thread by the needle. In contrast, when a sewing machine is modified with, and/or retrofitted with, the felting assembly 120, it may be advantageous to offset the felting needles 126 from the center axis of the needle bar 104 in order to also offset the felting needles 126 from the rotary hook and/or the bobbin which are beneath the needle plate 116. Offsetting the felting needles 126 from the rotary hook and/or the bobbin may prevent the felting needles 126 from unnecessarily hitting or otherwise contacting the rotary hook and/or the bobbin, as discussed in greater detail above in connection with FIGS. 2A and 2B, which illustrate the felting needles 126 reciprocating through the needle plate 116 and not contacting the rotary hook 160 and/or the bobbin which are beneath the needle plate 116.

In some embodiments, the hopping foot 130 may be configured to press the fabric 150 and/or a fibrous material 152 (see FIG. 1B) down against the needle plate 116. In some embodiments, the hopping foot 130 may be configured to be reciprocated by the presser bar 106. In some embodiments, the reciprocation of the presser bar 106 may not follow the same timing as the reciprocation of the needle bar 104. For example, the hopping foot 130 may be configured to press the fabric and/or the fibrous material down against the needle plate 116 before the felting needles 126 have reciprocated into the fabric and/or the fibrous material. Further, the hopping foot 130 may be configured to lift off of the fabric and/or the fibrous material after the felting needles 126 have reciprocated out of the fabric and/or the fibrous material. Thus, the hopping foot 130 may press the fabric and/or the fibrous material down prior to the felting needles 126 reciprocating into the fabric and/or the fibrous material, and hold the fabric and/or the fibrous material down until after the felting needles 126 have reciprocated up and out of the fabric and/or the fibrous material. Holding the fabric and/or the fibrous material down while the felting needles 126 are reciprocated up and out of the fabric and/or the fibrous material may be important because the barbs on the felting needles 126 may tend to pull the fabric and/or the fibrous material upward, which may, absent the holding down by the hopping foot 130, cause the fabric and/or the fibrous material to be pulled up and off of the needle plate 116.

In some embodiments, the hopping foot 130 may include the bowl 132 which may include an outer edge that may be configured to flatten the fibrous material 152 and/or the fabric 150 (see FIG. 1B) down against one or more of the other layers of the fabric into which the fibrous material (and/or another layer of fabric) is being felted. The rounded shape of the bowl 132 may be configured such that the bowl 132 may reciprocate up and down without catching on fibers of the fibrous material and/or on the fabric. Further, the rounded shape of the bowl 132 may be configured such that the bowl 132 may be moved laterally over the fibrous material and/or the fabric without catching.

In some embodiments, the hopping foot 130 may define a multi-needle opening sized and arranged to allow the felting needles 126 to reciprocate through the hopping foot 130.

In some embodiments, the gap 134 may be defined by the bowl 132 such that the hopping foot 130 does not contact the connector 122 or the needle bar 104. For example, while both the needle bar 104 and the presser bar 106 are reciprocated down, pushing the connector 122 and the hopping foot 130 down, the connector 122 and/or an end of the needle bar 104 may fit within the gap 134 such that the connector 122 and the presser bar 106 do not contact (e.g., interfere with) the hopping foot 130, as disclosed in FIG. 2B, which illustrates the presser bar 106 and the needle bar 104 reciprocated down and the end of the needle bar 104 being within the gap 134 such that the needle bar 104 does not contact the hopping foot 130.

In some embodiments, the foot connector 136 may be configured to receive and attach to the presser bar 106. As an example of how the hopping foot 130 may be connected to the presser bar 106, the foot connector 136 may include a screw to attach the foot connector 136 to the presser bar 106.

In some embodiments, the needle plate 116 may be configured to sit below the needle bar 104 and the presser bar 106, and to sit above the rotary hook 160 and the bobbin (see FIGS. 2A and 2B). The needle plate 116 may define multiple needle openings corresponding to the felting needles 126 and/or the needle-base openings in the underside of the needle clamp 124. The needle openings may allow the felting needles 126 to reciprocate through the needle plate 116. The needle openings may be sized and arranged to prevent a certain amount of fibers from passing through the needle plate 116. For example, the felting needles 126, including their barbs, may have a tendency to push fibers downward as the felting needles 126 are reciprocated downward through the needle plate 116. The needle openings may prevent the certain amount of fibers from passing through the needle plate 116.

In some embodiments, the needle plate 116 may define a first set of needle openings and a second set of needle openings. Thus, the needle plate 116 may be configured to be attached to the sewing machine 100 (see FIGS. 1A and 1B) in two different configurations. Additionally or alternatively, the needle plate 116 may be configured to be attached to two different types of sewing machines. For example, a first set of needle openings may be arranged to be positioned beneath the felting needles 126 when the needle plate 116 is attached to the sewing machine 100 (see FIGS. 1A and 1B)

in a first orientation or when the needle plate 116 is attached to a first type of sewing machine. Also, the second set of needle openings may be arranged to be positioned beneath the felting needles 126 when the needle plate 116 is attached to the sewing machine 100 (see FIGS. 1A and 1B) in a second orientation or when the needle plate 116 is attached to a second sewing machine of a second type.

Figure 4A:
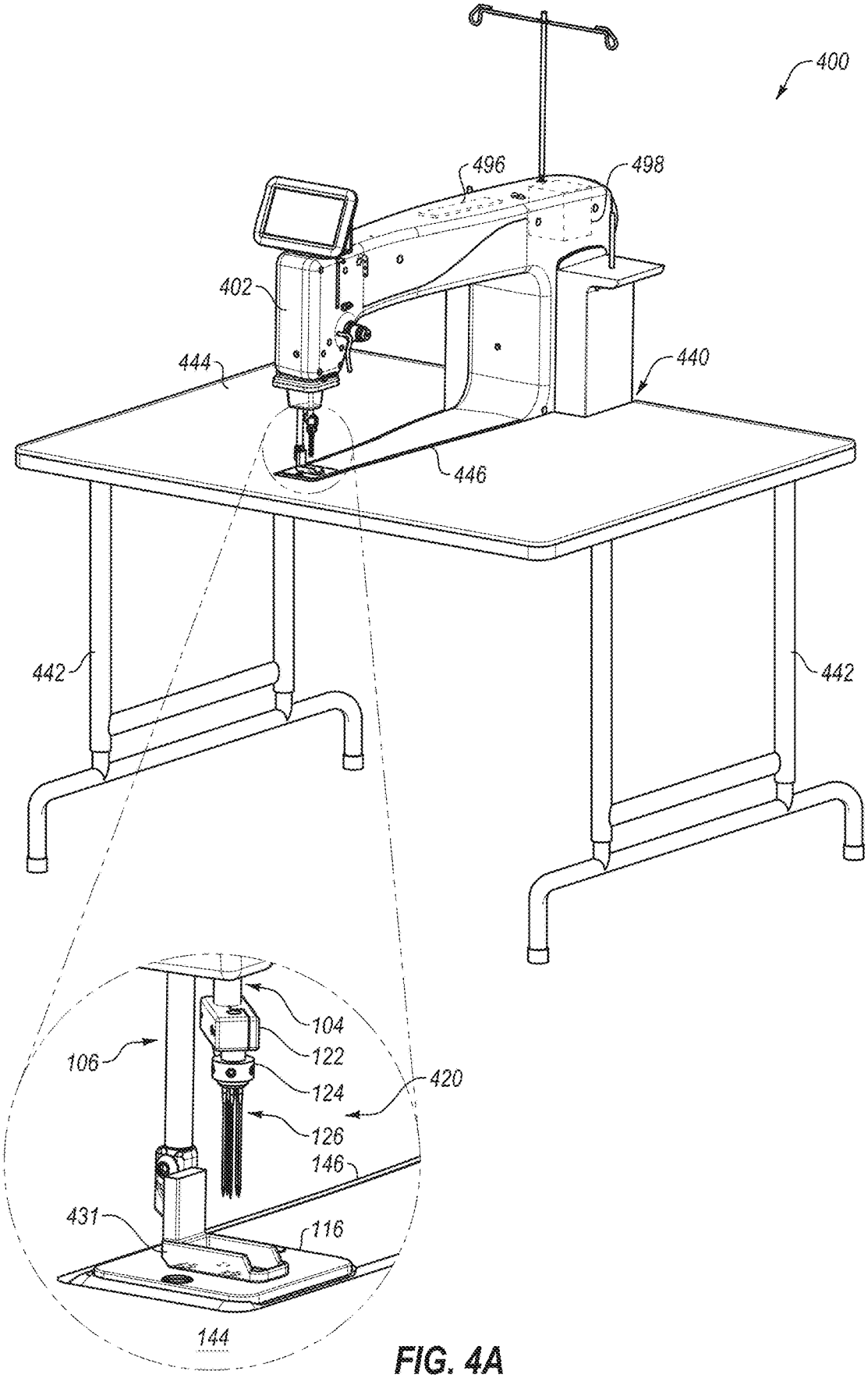
FIG. 4A is a front top perspective view of an example stationary sewing machine, with an example felting assembly, mounted on an example table.
Figure 4B:
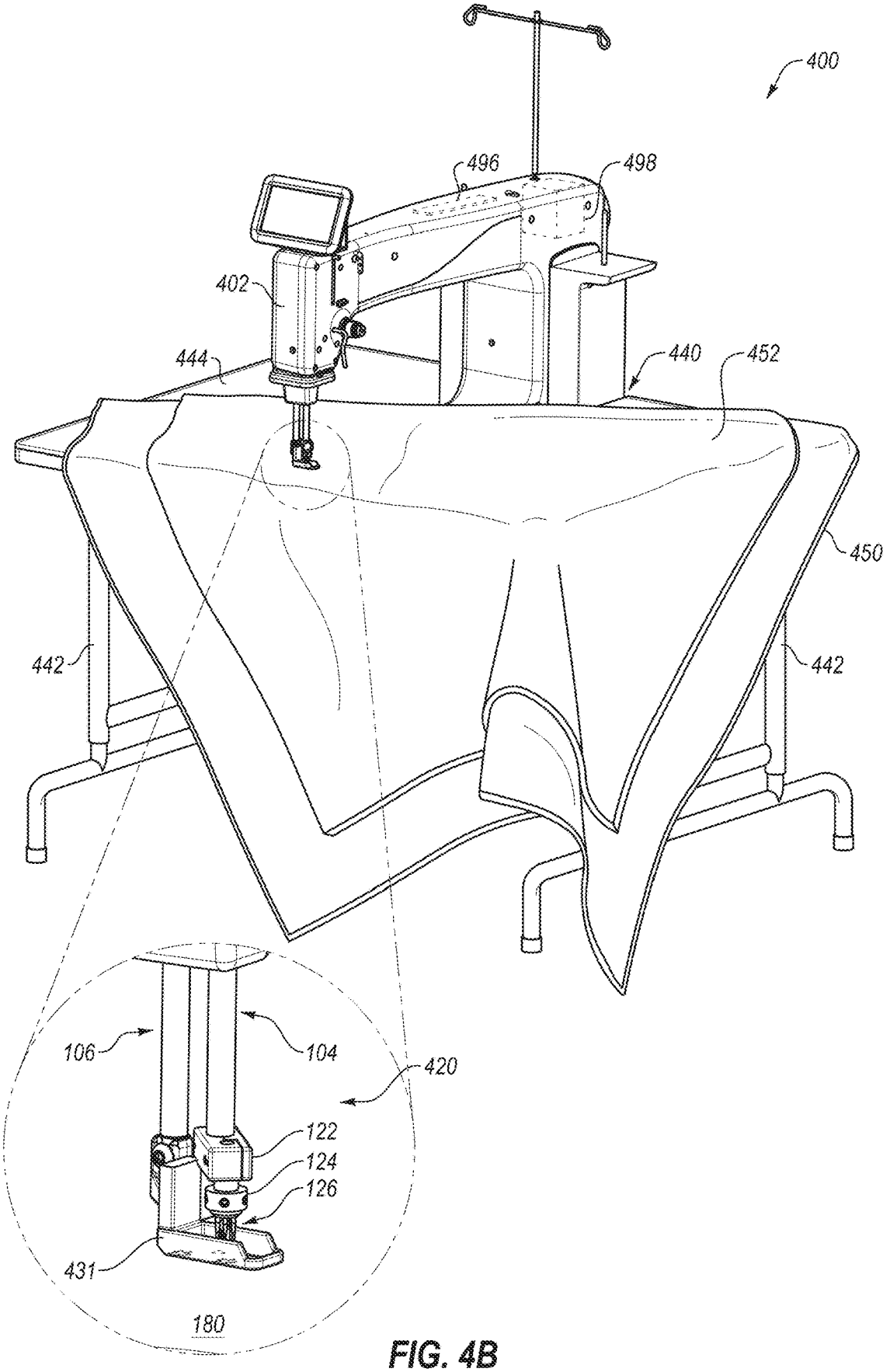
FIG. 4B is a front top perspective view of the example stationary sewing machine and example table of FIG. 4A with fabric positioned thereon.

FIG. 4A is a front top perspective view of an example stationary sewing machine 400, with an example felting assembly 420, mounted on an example table 440. FIG. 4B is a front top perspective view of the example stationary sewing machine 400 of FIG. 4A with fabric 450-452 positioned thereon.

The sewing machine 400 of FIGS. 4A and 4B is a quilting machine and, more particularly, a long-arm quilting machine. Prior to being sewn into a quilt, the fabric 450-452 may initially be multiple layers of fabric tacked together, such as a batting fabric tacked between a backing fabric and a quilt-top fabric. Although the sewing machine 400 of FIGS. 4A and 4B is a stationary long-arm quilting machine, it is understood that the sewing machine 400 of FIGS. 4A and 4B is only one of countless stationary sewing machines in which the example felting assemblies disclosed herein may be employed. The scope of the example felting assemblies disclosed herein is therefore not intended to be limited to employment in any particular stationary sewing machine or quilting machine.

As disclosed in FIGS. 4A and 4B, the sewing machine 400 may include a frame 402 which houses various internal components of the sewing machine 400, such as a processor 496 and a motor 498. The sewing machine 400 may also include a needle bar 104 that is configured to have one or more needles attached thereto. The motor 498 may be configured to cause the needle bar 104 to reciprocate with respect to the frame 402 such that the one or more needles reciprocate into and out of the fabric 450-452. In a typical sewing-machine configuration, a top thread from a spool (not shown) may be passed through various thread guides, including a take-up lever, until finally the top thread is threaded through the eye of the needle. Although not shown in FIGS. 4A and 4B, it is understood that the sewing machine 400 may also include a bobbin case configured to hold a bobbin that is wound with bottom thread, and a rotary hook (which may also be driven by the motor 498 or another synchronized motor), all generally positioned in the frame 402 underneath a needle plate 116.

To facilitate use of the sewing machine 400 by a user, the sewing machine 400 may be mounted on the table 440. The table 440 may include legs 442 and a table top 444. The table top 444 may include a recess 446 into which the sewing machine 400 may be mounted such that the top surface of the needle plate 416 is generally flush with the top surface of table top 444. When mounted to the table 440, the sewing machine 400 is configured as a stationary sewing machine (sometimes also referred to as a sit-down sewing machine) in which the sewing machine 400 is configured to remain stationary during operation while a user repositions the fabric 450-452 in a desired direction underneath the needle. Although two layers of fabric are illustrated in FIG. 4B, any single one of the layers of fabric 450-452 may be used, or more than two layers of fabric may be used. Additionally, a fibrous material may be placed on top of the layers of fabric 450-452.

In some embodiments, a user may periodically replace a typical sewing needle and other components that would typically be employed in the sewing machine 400 with the felting assembly 420, and vice versa, to switch between using the sewing machine 400 as a sewing machine and as a felting machine. The felting assembly 420 may include the connector 122, the needle clamp 124, the felting needles 126, or the needle plate 116, or some combination thereof, each of which is described above in connection with FIGS. 1A-3B.

Additionally or alternatively, in some embodiments, the felting assembly 420 may include a presser foot 431, which may replace a typical foot. The presser foot 431 may be similar to the hopping foot 130 of FIGS. 1A-3B, except that the presser foot 431 may not be configured to hop up and down, but may instead be configured to continuously press a fibrous material, and/or the fabric 450-452, against the needle plate 116. For example, because the sewing machine 400 is configured to remain stationary while the fabric 450-452 is moved under the sewing machine 400, the presser foot 431 may be configured to be raised and lowered manually by a presser-bar lever without reciprocating. Additionally or alternatively, the presser foot 431 may define a multi-needle opening through which the felting needles 126 may be configured to reciprocate.

Figure 5A:
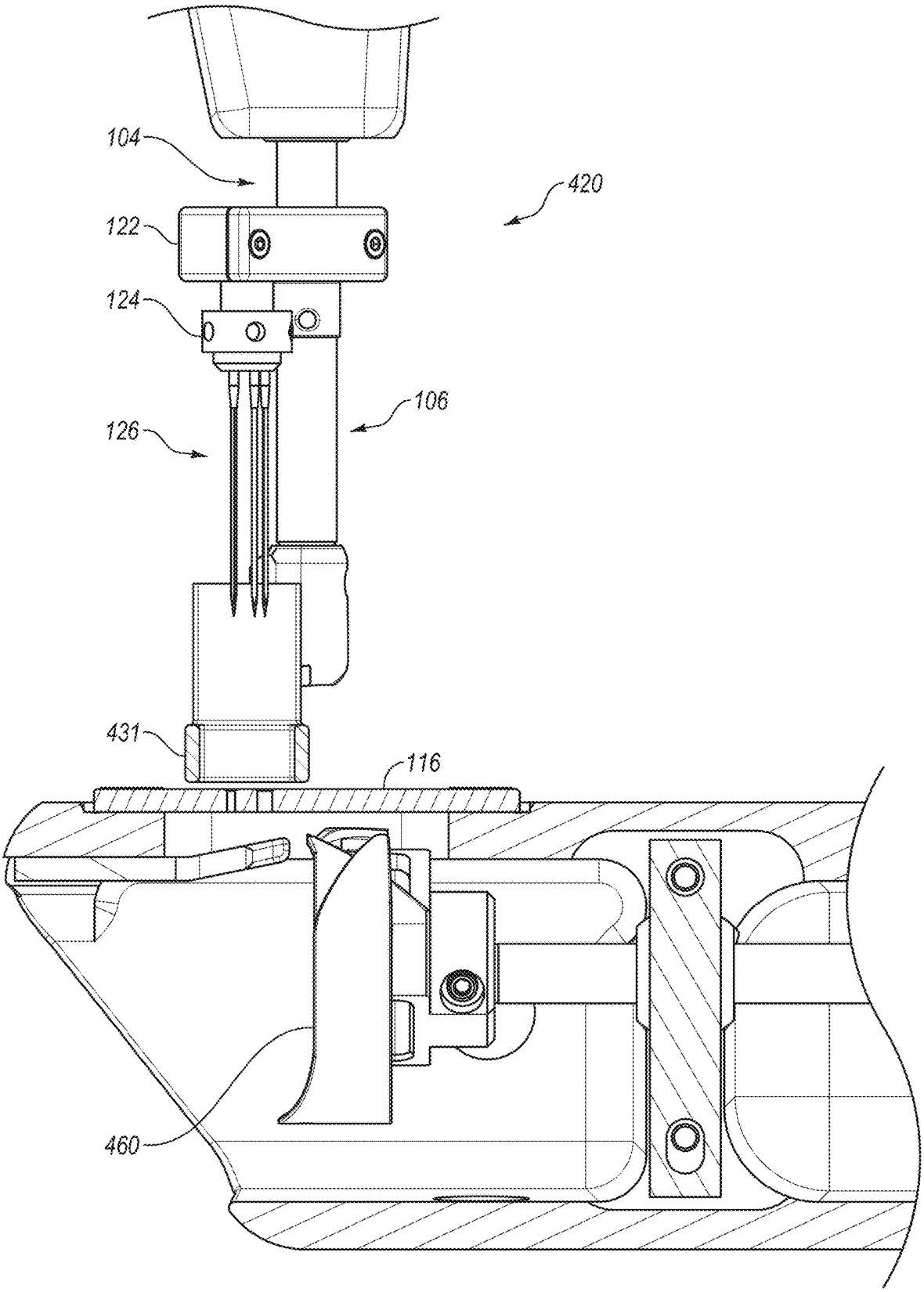
FIG. 5A is a cross-section view of the example stationary sewing machine of FIG. 4A with the needle bar in an up position.

FIG. 5A is a cross-section view of the example stationary sewing machine 400 of FIG. 4A with the needle bar 104 in an up position. With the needle bar 104 in the up position, the felting needles 126 are above the fabric and/or the fibrous material (not shown in FIG. 5A) being felted. Also, FIG. 5A illustrates the presser bar 106 in a down position in which the presser foot 431 is pressing the fabric and/or the fibrous material (not shown) against the needle plate 116.

Figure 5B:
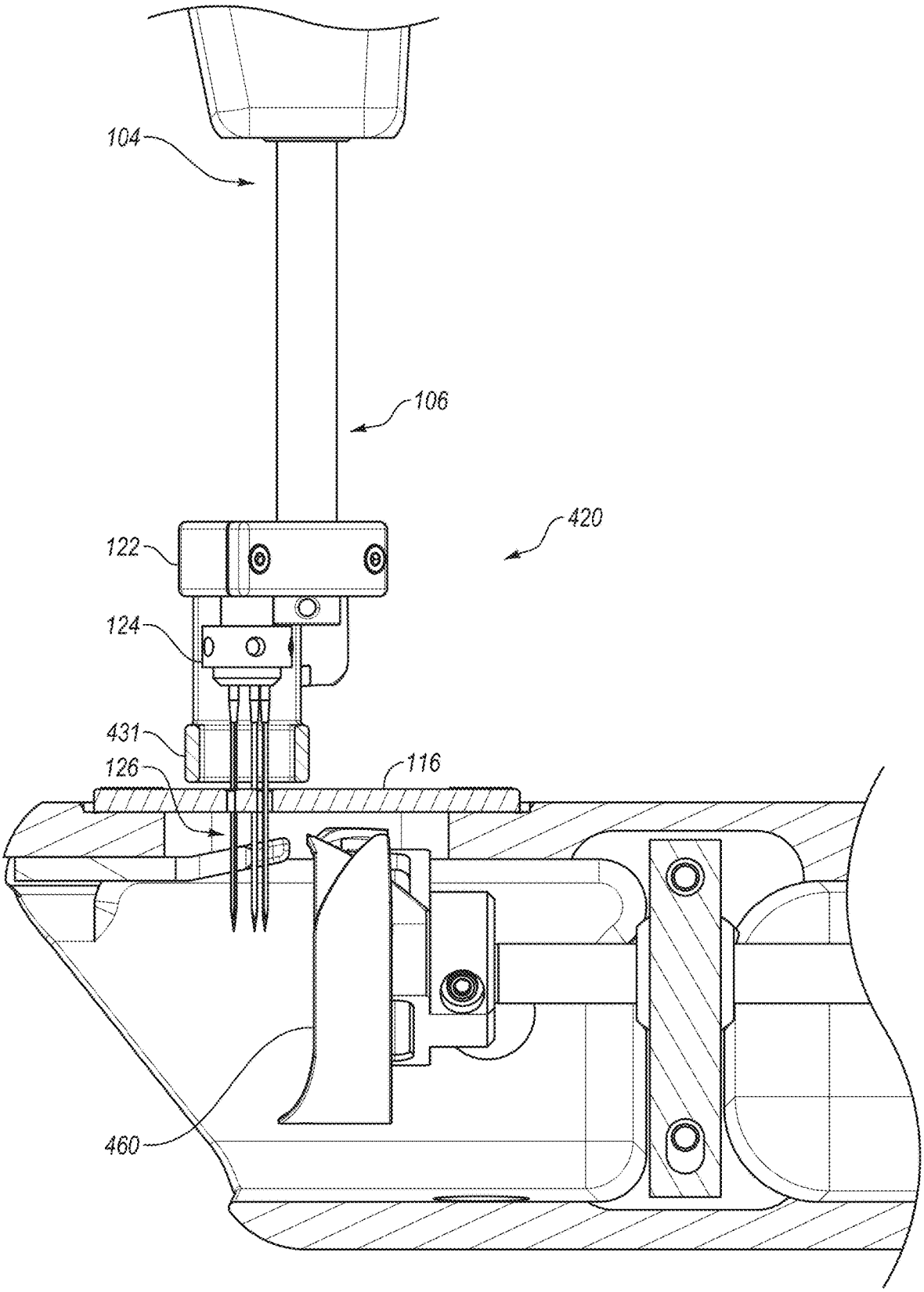
FIG. 5B is a cross-section view of the example stationary sewing machine of FIG. 4A with the needle bar in a down position.

FIG. 5B is a cross-section view of the example stationary sewing machine 400 of FIG. 4A with the needle bar 104 in a down position. With the needle bar 104 in the down position, portions of the felting needles 126 extend through the needle plate 116. As can be seen in FIG. 5B, with the felting needles 126 reciprocated down through the needle plate 116, because of the offset caused by the connector 122, the felting needles 126 do not contact the rotary hook 460 and/or the bobbin.

Although a needle clamp is disclosed herein that includes multiple felting needles, in some embodiments a needle clamp may instead include only a single felting needle, or may be replaced by a single felting needle. Further, although a needle plate is disclosed herein that includes multiple openings arranged to allow for multiple felting needles to reciprocate therethrough, in some embodiments a needle plate may instead include only a single needle opening arranged to allow for only a single felting needle to reciprocate therethrough. Also, although a needle plate is disclosed herein that is configured with to be attached to a sewing machine in multiple orientations, in some embodiments a needle plate may instead be configured to be attached to a sewing machine in only a single orientation. Further, a hopping foot is disclosed herein that is bowl shaped, in some embodiments a hopping foot may have another shape.

Embodiments of the motors, controllers, and sensors described herein may be implemented using non-transitory computer-readable media for carrying or having computer-executable instructions or data structures stored thereon. Such computer-readable media may be any available media that may be accessed by a general-purpose or special-purpose computer. By way of example, and not limitation, such computer-readable media may include non-transitory computer-readable storage media including RAM, ROM, EEPROM, CD-ROM or other optical disk storage, magnetic disk storage or other magnetic storage devices, or any other storage medium which may be used to carry or store one or more desired programs having program code in the form of computer-executable instructions or data structures and which may be accessed and executed by a general-purpose computer, special-purpose computer, or virtual computer such as a virtual machine. Combinations of the above may also be included within the scope of computer-readable media.

Computer-executable instructions comprise, for example, instructions and data which, when executed by one or more processors, cause a general-purpose computer, special-purpose computer, or virtual computer such as a virtual machine to perform a certain method, function, or group of methods or functions. Although the subject matter has been described in language specific to structural features and/or methodological steps, it is to be understood that the subject matter defined in the appended claims is not necessarily limited to the specific features or steps described above. Rather, the specific features and steps described above are disclosed as example forms of implementing the claims.

As used herein, the term "program" may refer to software objects or routines that execute on a computing system. The different programs described herein may be implemented as objects or processes that execute on a computing system (e.g., as separate threads).

All examples and conditional language recited herein are intended for pedagogical objects to aid the reader in understanding the example embodiments and the concepts contributed by the inventor to furthering the art, and are to be construed as being without limitation to such specifically-recited examples and conditions.

The invention claimed is:

1. A quilting machine comprising:

a frame;

a needle bar coupled to the frame and configured to reciprocate;

a presser bar coupled to the frame and configured to reciprocate;

a rotary hook coupled to the frame and configured to rotate; and a felting assembly including:

a felting needle clamp including two or more felting needles;

a needle plate defining two or more needle openings arranged to allow the two or more felting needles to reciprocate therethrough, the two or more needle openings including a total number of needle openings that is at least as high as the number of felting needles included in the felting needle clamp, the needle plate attached to the frame over the rotary hook, all of the two or more needle openings defined in the needle plate being offset to one side of a plane defined by a center axis of the needle bar and a length of the frame;

a connector attaching the felting needle clamp to the needle bar such that the felting needle clamp is offset from the rotary hook to avoid the two or more felting needles from contacting the rotary hook while the two or more felting needles are reciprocated through the two or more needle openings in the needle plate; and a hopping foot attached to the presser bar and defining a felting opening configured to allow the two or more felting needles to reciprocate therethrough, the hopping foot configured to automatically reciprocate between automatically pressing fabric down against the needle plate before the two or more felting needles have reciprocated into the fabric and automatically lifting off of the fabric after the two or more felting needles have reciprocated out of the fabric.

2. The quilting machine of claim 1, wherein the quilting machine is a long-arm quilting machine.

3. The quilting machine of claim 1, wherein:

the hopping foot defines a bowl, having a bowl-shaped interior with a circular horizontal cross section, that surrounds the felting opening.

4. The quilting machine of claim 3, wherein the bowl surrounds and defines a multi-needle opening configured to allow the two or more felting needles to reciprocate therethrough.

5. The quilting machine of claim 4, wherein the bowl further defines an open gap configured such that the hopping foot avoids the connector and the needle bar when the hopping foot is reciprocated up into its highest position.

6. The quilting machine of claim 5, wherein an outer edge of the bowl is configured to flatten a fibrous material against the fabric as the bowl is reciprocated onto the fibrous material and the fabric.

7. The quilting machine of claim 1, wherein the connector defines a first opening configured to receive and attach to the needle bar and a second opening configured to receive and attach to the felting needle clamp.

8. The quilting machine of claim 1, wherein:

the two or more needle openings defined in the needle plate include a first set of two or more needle openings arranged to be positioned beneath the two or more felting needles when the needle plate and the felting needle clamp are attached to the quilting machine in a first orientation and a second set of two or more needle openings arranged to be positioned beneath the two or more felting needles when the needle plate and the felting needle clamp are attached to a second quilting machine in a second orientation; and the first and second sets of two or more needle openings include a combined total number of needle openings that is twice the number of felting needles included in the felting needle clamp.

9. A quilting machine comprising:

a frame;

a needle bar coupled to the frame and configured to reciprocate;

a presser bar coupled to the frame and configured to reciprocate;

a rotary hook coupled to the frame and configured to rotate; and a felting assembly including:

a felting needle clamp including two or more felting needles;

a needle plate defining two or more needle openings arranged to allow the two or more felting needles to reciprocate therethrough, the needle plate attached to the frame over the rotary hook;

a connector attaching the felting needle clamp to the needle bar such that the felting needle clamp is offset from the rotary hook to avoid the two or more felting needles from contacting the rotary hook while the two or more felting needles are reciprocated through the two or more needle openings in the needle plate; and a hopping foot attached to the presser bar and defining a felting opening configured to allow the two or more felting needles to reciprocate therethrough, the hopping foot configured to automatically reciprocate between automatically pressing fabric down against the needle plate before the two or more felting needles have reciprocated into the fabric and automatically lifting off of the fabric after the two or more felting needles have reciprocated out of the fabric;

wherein:

the two or more needle openings defined in the needle plate include a first set of two or more needle openings arranged to be positioned beneath the two or more felting needles when the needle plate and the felting needle clamp are attached to the quilting machine in a first orientation and a second set of two or more needle openings arranged to be positioned beneath the two or more felting needles when the needle plate and the felting needle clamp are attached to a second quilting machine in a second orientation; and the first and second sets of two or more needle openings include a combined total number of needle openings that is twice the number of felting needles included in the felting needle clamp.

10. The quilting machine of claim 9, wherein the quilting machine is a long-arm quilting machine.

11. The quilting machine of claim 9, wherein the hopping foot defines a bowl, having a bowl-shaped interior with a circular horizontal cross section, that surrounds the felting opening.

12. The quilting machine of claim 11, wherein the bowl surrounds and defines a multi-needle opening configured to allow the two or more felting needles to reciprocate therethrough.

13. The quilting machine of claim 12, wherein the bowl further defines an open gap configured such that the hopping foot avoids the connector and the needle bar when the hopping foot is reciprocated up into its highest position.

14. The quilting machine of claim 13, wherein an outer edge of the bowl is configured to flatten a fibrous material against the fabric as the bowl is reciprocated onto the fibrous material and the fabric.

15. The quilting machine of claim 9, wherein the connector defines a first opening configured to receive and attach to the needle bar and a second opening configured to receive and attach to the felting needle clamp.

16. The quilting machine of claim 9, wherein:

the two or more needle openings includes a total number of needle openings that is at least as high as the number of felting needles included in the felting needle clamp; and all of the two or more needle openings defined in the needle plate are offset to one side of a plane defined by a center axis of the needle bar and a length of the frame.

17. A quilting machine comprising:

a frame;

a needle bar coupled to the frame and configured to reciprocate;

a presser bar coupled to the frame and configured to reciprocate;

a rotary hook coupled to the frame and configured to rotate; and a felting assembly including:

a felting needle clamp including two or more felting needles;

a needle plate defining two or more needle openings arranged to allow the two or more felting needles to reciprocate therethrough, the two or more needle openings including a total number of needle openings that is at least as high as the number of felting needles included in the felting needle clamp, the needle plate attached to the frame over the rotary hook, all of the two or more needle openings defined in the needle plate being offset to one side of a plane defined by a center axis of the needle bar and a length of the frame;

a connector attaching the felting needle clamp to the needle bar such that the felting needle clamp is offset from the rotary hook to avoid the two or more felting needles from contacting the rotary hook while the two or more felting needles are reciprocated through the two or more needle openings in the needle plate; and a hopping foot attached to the presser bar and defining a felting opening configured to allow the two or more felting needles to reciprocate therethrough, the hopping foot configured to automatically reciprocate between automatically pressing fabric down against the needle plate before the two or more felting needles have reciprocated into the fabric and automatically lifting off of the fabric after the two or more felting needles have reciprocated out of the fabric;

wherein:

the two or more needle openings defined in the needle plate include a first set of two or more needle openings arranged to be positioned beneath the two or more felting needles when the needle plate and the felting needle clamp are attached to the quilting machine in a first orientation and a second set of two or more needle openings arranged to be positioned beneath the two or more felting needles when the needle plate and the felting needle clamp are attached to a second quilting machine in a second orientation; and the first and second sets of two or more needle openings include a combined total number of needle openings that is twice the number of felting needles included in the felting needle clamp.

18. The quilting machine of claim 17, wherein the quilting machine is a long-arm quilting machine.

19. The quilting machine of claim 17, wherein the hopping foot defines a bowl, having a bowl-shaped interior with a circular horizontal cross section, that surrounds the felting opening.

20. The quilting machine of claim 19, wherein the bowl surrounds and defines a multi-needle opening configured to allow the two or more felting needles to reciprocate therethrough.

21. The quilting machine of claim 20, wherein the bowl further defines an open gap configured such that the hopping foot avoids the connector and the needle bar when the hopping foot is reciprocated up into its highest position.

22. The quilting machine of claim 21, wherein an outer edge of the bowl is configured to flatten a fibrous material against the fabric as the bowl is reciprocated onto the fibrous material and the fabric.

23. The quilting machine of claim 17, wherein the connector defines a first opening configured to receive and attach to the needle bar and a second opening configured to receive and attach to the felting needle clamp.

* * * * *